US007780421B2

(12) United States Patent
Freiberger

(10) Patent No.: US 7,780,421 B2
(45) Date of Patent: Aug. 24, 2010

(54) REFRIGERANT COMPRESSOR

(75) Inventor: Alfred Freiberger, Grosswilfersdorf (AT)

(73) Assignee: ACC Austria GmbH, Fürstenfeld (AT)

( * ) Notice: Subject to any disclaimer, the term of this patent is extended or adjusted under 35 U.S.C. 154(b) by 378 days.

(21) Appl. No.: 10/587,689

(22) PCT Filed: Jan. 31, 2005

(86) PCT No.: PCT/AT2005/000026

§ 371 (c)(1),
(2), (4) Date: Jul. 27, 2006

(87) PCT Pub. No.: WO2005/073558

PCT Pub. Date: Aug. 11, 2005

(65) Prior Publication Data

US 2007/0154330 A1 Jul. 5, 2007

(30) Foreign Application Priority Data

Jan. 29, 2004 (AT) ..... GM59/2004
Dec. 22, 2004 (AT) ..... GM933/2004

(51) Int. Cl.
*F04B 39/00* (2006.01)
*F04B 53/00* (2006.01)

(52) U.S. Cl. ..... 417/312; 417/902; 181/247

(58) Field of Classification Search ..... 417/312, 417/902, 540, 443; 181/247, 212
See application file for complete search history.

(56) References Cited

U.S. PATENT DOCUMENTS 4,109,751 A * 8/1978 Kabele ..... 181/247
4,370,104 A * 1/1983 Nelson et al. ..... 417/312
4,755,108 A * 7/1988 Todescat et al. ..... 417/312
5,201,640 A * 4/1993 Heinzelmann et al. ..... 417/312
5,496,156 A 3/1996 Harper et al.
6,017,197 A * 1/2000 Jensen et al. ..... 417/312
6,390,788 B1 5/2002 Tack
6,506,028 B2 1/2003 Silveira et al.
6,763,909 B2 * 7/2004 Svendsen ..... 181/227
7,052,247 B2 * 5/2006 Lee ..... 417/312
2005/0002798 A1 * 1/2005 Bjerre et al. ..... 417/312

FOREIGN PATENT DOCUMENTS

DE 195 22 383 1/1997
EP 181 019 B1 5/1986
JP 09 195936 7/1997
JP 11 062827 3/1999
WO WO 03/038280 5/2003

* cited by examiner

*Primary Examiner*—Devon C Kramer
*Assistant Examiner*—Peter J Bertheaud
(74) *Attorney, Agent, or Firm*—Collard & Roe, P.C.

(57) ABSTRACT

A refrigerant compressor has a hermetically tight compressor housing inside of which a piston-cylinder unit operates. A suction muffler through which refrigerant flows to the intake valve of the piston-cylinder unit is provided on the cylinder head. The inlet of the suction muffler has a cross section via which refrigerant flows into the suction muffler. A compensating volume is provided inside of which refrigerant oscillates and which is connected to the suction muffler and the interior of the compressor housing. The cross section of the inlet also acts as the connecting port between the compensating volume and the filling volume. The compensating volume is formed by an outer tube directed into the compressor housing, which tightly surrounds the intake port of the inlet while surrounding the section of the refrigerant suction pipe that is connected to the evaporator of the compressor and extends into the interior of the compressor housing.

8 Claims, 2 Drawing Sheets

REFRIGERANT COMPRESSOR

CROSS REFERENCE TO RELATED APPLICATIONS

Applicant claims priority under 35 U.S.C. §119 of Austrian Application Nos. GM 59/2004 filed Jan. 29, 2004 and GM 933/2004, filed Dec. 22, 2004. Applicant also claims priority under 35 U.S.C. §365 of PCT/AT2005/000026 filed Jan. 31, 2005. The international application under PCT article 21 (2) was not published in English.

TECHNICAL FIELD

The present invention relates to a hermetically encapsulated refrigerant compressor, comprising a hermetically sealed compressor housing, in the interior of which a piston-cylinder unit works which compresses a refrigerant, on the cylinder head of which a suction muffler is arranged through which the refrigerant flows to the suction valve of the piston-cylinder unit, according to the preamble of claim 1.

Such refrigerant compressors have long been known and are predominantly used in refrigerators and cooling shelves. The annually produced number is accordingly very high.

Although the power consumption of an individual refrigerant compressor is only approximately between 50 and 150 watts, there is a very high power consumption when regarding all refrigerant compressors used worldwide, which consumption increases continuously as a result of the rapidly progressing development in poorer countries too.

Any technical improvement made to a refrigerant compressor and increasing the efficiency thus offers an enormous potential for saving energy when extrapolating the refrigerant compressors used worldwide.

The refrigerant process as such has long been known. The refrigerant is heated in the compressor by taking up energy from the space to be cooled and finally overheats and is pumped by means of the refrigerant compressor to a higher pressure level where it emits heat via a condenser and is conveyed back to the evaporator via a throttle where there is a pressure reduction and a cooling of the refrigerant.

The largest and most important potential for a possible potential for a possible improvement of efficiency lies in the lowering of the temperature of the refrigerant at the beginning of its compression process. Every lowering of the intake temperature of the refrigerant into the cylinders of the piston-cylinder unit leads to a reduction of the required technical work for the compression process, as does the lowering of the temperature during the compression process and, in connection with the same, the push-out temperature.

DESCRIPTION OF THE PRIOR ART

In known hermetically encapsulated refrigerant compressors there is a strong heating of the refrigerant on its path from the compressor (cooling space) to the intake valve of the piston-cylinder unit as a result of the design.

The intake of the refrigerant occurs via a suction pipe coming directly from the compressor during an intake stroke of the piston-cylinder unit. In known hermetically encapsulated refrigerant compressors, the suction pipe usually opens into the hermetically encapsulated compressor housing, mostly close to the entrance cross section into the suction muffler, from where the refrigerant flows into the suction muffler and from the same directly into the intake valve of the piston-cylinder unit. The muffler is used primarily to keep the noise level of the refrigerant compressor as low as possible during the intake process. Known mufflers usually consist of several volumes which are in connection with each other and an intake cross section through which the refrigerant is sucked from the hermetically encapsulated compressor housing volume to the interior of the muffler and an opening which lies close to the intake valve of the piston-cylinder unit.

On the way between the entrance of the refrigerant into the compressor housing and the intake valve of the piston-cylinder unit there is (as already mentioned) an undesirable heating of the refrigerant. Measurements have shown that a refrigerant temperature of 32° C. in the suction pipe (predetermined by standardized ASHRAE conditions) the refrigerant was heated already in the first muffler volume to a temperature of approx. 54° C. already shortly before entering the compressor housing. The cause for this undesirable heating of the refrigerant is the fact that the refrigerant freshly flowing from the suction pipe to the compressor housing is mixed with warmer refrigerant already situated in the compressor housing. The mixture is principally caused in such a way that the intake valve of the piston-cylinder unit is merely open over a crank angle range of approx. 180° and that refrigerant can be drawn into the cylinder of the refrigerant compressor merely within this time window. The intake valve is closed thereafter, during the compression cycle. The cold refrigerant has a virtually constant mass flow, even when the intake valve is closed, as a result of which it flows in from behind into the compressor housing and dwells there and cools the piston-cylinder unit in motion and its components, which again causes a heating of the refrigerant. As a result of the pressure oscillations during the compression phase, there are further flow processes from the compressor housing to the muffler and vice-versa, which thus causes an additional mixing.

In order to prevent this thorough mixture of warm refrigerant from the interior of the compressor housing with refrigerant freshly coming from the evaporator, the outlet of the suction pipe for the refrigerant is placed in known refrigerant compressors close to the inlet cross section of the muffler. This ensures that a relatively low amount of cold refrigerant can escape from the evaporator into the interior of the compressor housing. Subsequently, the suction pipe end was configured in such a way an intermediate pipe could be inserted into the same. At the same time, the intermediate pipe was enclosed by a spiral spring which rests on the one hand on the entrance of the suction pipe into the housing and on the other hand on the intermediate pipe in order to achieve a linkage of the suction pipe to the muffler. All these known efforts to prevent a mixture of the cold refrigerant from the evaporator with the heated refrigerant in the interior of the compressor housing have merely caused a reduction in this mixing, but not a complete prevention.

It is known from WO 03/038280 to directly connect the entrance cross section of the muffler with the outlet of the suction pipe, so that refrigerant coming from the evaporator is guided directly into the muffler without reaching the interior of the compressor housing and without being heated there. As a result of the already mentioned fact that the cold refrigerant has a nearly constant mass flow even when the intake valve is closed and flows into the muffler (now via the direct connection), it is necessary to provide a compensating volume in the muffler in order to compensate a pressure rise in the muffler as a result of the refrigerant that is continuously flowing in and through which refrigerant contained in the muffler can flow out of the same again into the compressor housing. During the next intake stroke, the refrigerant situated in the muffler or flowing from the suction pipe into the muffler is drawn into the piston-cylinder unit via the intake valve on the one hand, and refrigerant situated in the interior of the compressor housing is drawn into the compensating volume for pressure compensation (as a result of leakage from the piston-cylinder unit and by the mentioned flow-out from the muffler), but not into the muffler on the other hand.

The flow conditions occurring thereby, especially during the overflow into the compensating volume which would not occur without a direct connection of suction pipe with the muffler, lead to the likelihood of increased flow losses.

As already mentioned, the refrigerant compressor as disclosed in WO 03/038280 requires a tight connection between the suction pipe, leading to increased work in assembly in order to ensure the tightness, such that a bellows-like connection element needs to be connected in a tight manner with the compressor housing on the one hand and in a tight manner with the muffler on the other hand. In the case that the bellows-like connection element loses its tightness, the desirable lowering of the refrigerant temperature at the beginning of the compression process can no longer be achieved and the refrigerant compressor works with a lower efficiency again. The problematic aspect in connection with this fact is that the compressor housing is not sealed in a hermetically tight manner by means of a weld seam for example, so that any potential failure of the tight connection between suction pipe and muffler would therefore not be noticeable to the operator.

SUMMARY OF THE INVENTION

It is therefore the object of the present invention to avoid this disadvantage and to provide a refrigerant compressor of the kind mentioned above in which the refrigerant temperature is kept as low as possible at the beginning of the compression process and thus necessarily also during the intake into the cylinder of the piston-cylinder unit, such that the inflow of the refrigerant coming from the evaporator into the interior of the compressor housing is avoided and at the same time the flow losses during the intake are avoided as far as possible, with the operational security being improved.

This is achieved in accordance with the invention by a hermetically encapsulated refrigerant compressor comprising a hermetically sealed compressor housing, a piston-cylinder unit disposed in an interior of the housing for compressing a refrigerant and comprising a suction valve with an intake port arranged in a valve plate of the suction valve, and a suction muffler disposed on the cylinder head of the piston-cylinder unit. The suction muffler comprises a filling volume through which the refrigerant flows to the suction valve of the piston-cylinder unit, an inlet cross section through which refrigerant flows into the suction muffler, and a compensating volume in connection with the suction muffler and the interior of the compressor housing and in which the refrigerant oscillates. The inlet cross section is simultaneously a connecting port between the compensating volume and the filling volume, and the compensating volume is formed by an outer tube which tightly encloses the intake port or the inlet cross section and encloses the refrigerant suction pipe at least along a section and is directed into the compressor housing, which suction pipe extends into the interior of the compressor housing. The compensating volume and filling volume are arranged so that refrigerant from the suction pipe flows into the compensating volume by passing through the filling volume.

There is thus no necessity for a tight connection between suction pipe and suction muffler. The same result can be achieved by the construction in accordance with the invention, such that the inlet cross section into the suction muffler is simultaneously the connecting port between the compensating volume and filling volume and the compensating volume is formed by an outer tube which on the one hand tightly encloses the intake port or the inlet cross section and on the other hand encloses the refrigerant suction pipe at least along a section and is directed into the compressor housing, which suction pipe is connected with the evaporator of the refrigerant compressor and extends into the interior of the compressor housing.

It is ensured that sufficient compensating volume is available due to the suction pipe being guided shortly to a point shortly before the intake port in the outer tube.

The integral configuration of suction muffler and compensating volume, allow an especially cost-effective and rapid possibility for production.

By creating a compensating volume with a volume corresponding to 0.5 to 1.2 times the working volume of the piston-cylinder unit, it is guaranteed that the refrigerant coming from the suction pipe will not reach the compressor housing even when the intake valve is closed and will mix there with the already heated refrigerant. It is guaranteed at the same time that during the intake process no refrigerant is drawn from the compressor housing via the compensating volume into the suction muffler or into the cylinder.

As a result of the creation of a compensating volume which is at least half, preferably 0.5 to 3 times the working volume of the piston of the piston-cylinder unit, the noise development following the creation of the compensating volume as a result of the flow processes into the compensating volume and into the compressor housing can be minimized in addition, so that there is no noise development which might be disturbing to the operator, which is especially important for household refrigerators. Moreover, a slightly larger compensating volume is more easy to produce from a production standpoint.

The smallest flow cross section in the compensating volume has a cross-sectional surface area which corresponds to ¼ to ¾ of the cross-sectional surface area of the intake opening. This ensures that the pressure difference becomes small, leading to a reduction in the flow losses and high noise damping to the outside.

The cross section of the compensating volume can correspond at most to 1.5 times the piston head surface area. This ensures that on the one hand the need for space for the compensating volume will not become too large and on the other hand it is ensured that cold and warm suction gas will not mix or the boundary layer as described below will not form.

In a preferred embodiment, the compensating volume has a circular cross section and the ratio of the length of the compensating volume to its diameter is higher than 10, which leads to especially low flow losses.

DETAILED DESCRIPTION OF THE PREFERRED EMBODIMENTS

The invention will now be explained in closer detail by reference to the drawings, wherein:

FIG. 1 shows a sectional view through a hermetically encapsulated refrigerant compressor. A piston-cylinder unit is elastically held by means of springs 2 in the interior of a hermetically sealed compressor housing 1.

Figure 1:
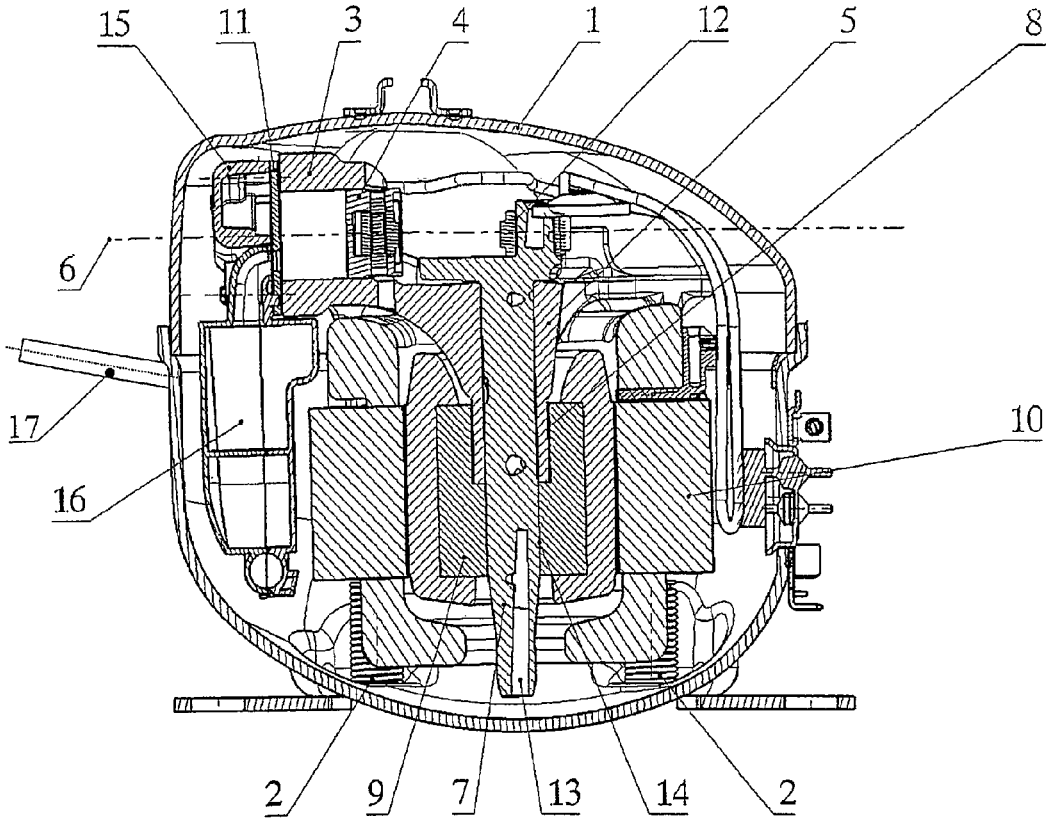
FIG. 1 shows a sectional side view of a refrigerant compressor hermetically encapsulated in accordance with the invention.

The piston-cylinder-motor unit substantially consists of a cylinder housing 3 and the piston 4 performing a lifting movement therein, and a crankshaft bearing 5 which is arranged perpendicular to the cylinder axis 6. The crankshaft bearing 5 receives a crankshaft 7 and protrudes into a centric bore 8 of rotor 9 of an electromotor 10. A connecting rod bearing 12 is situated at the upper end of crankshaft 7, through which the connecting rod and consequently the piston 4 are driven. The crankshaft 7 comprises a lubricating oil bore 13 and is fixed to rotor 9 in the area 14. The muffler 16 is arranged on the cylinder head 15, which muffler is to reduce noise development to a minimum during the intake process of the refrigerant.

Figure 2:
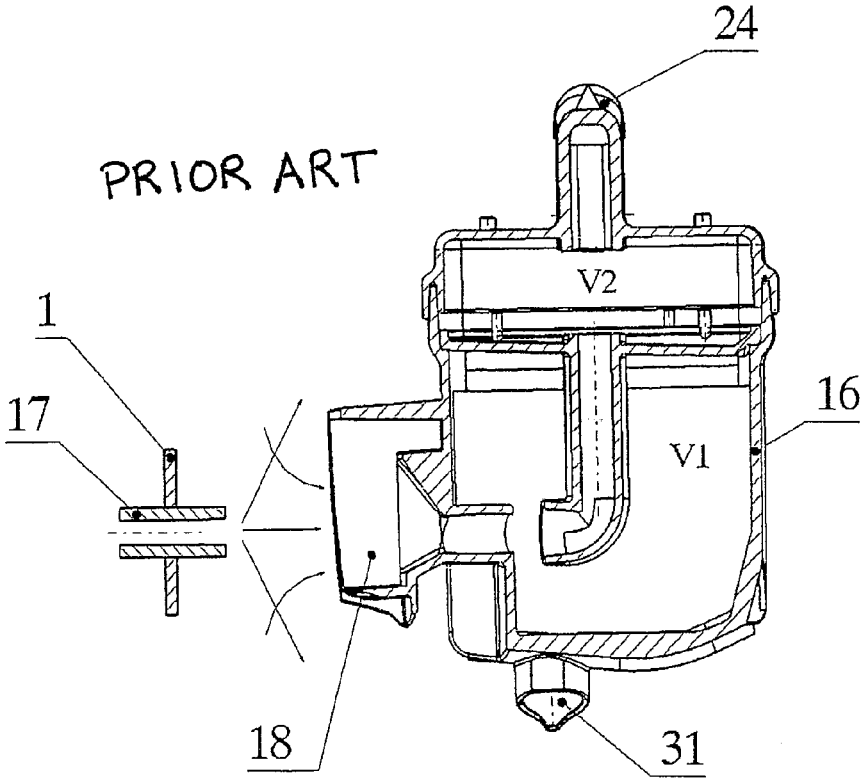
FIG. 2 shows a sectional view of a suction muffler in accordance with the state of the art.

FIG. 2 shows a sectional view of a suction muffler 16 according to the state of the art. As is already shown in FIG. 1, the muffler 16 is arranged on the cylinder head 15 in the interior of the hermetically sealed compressor housing 1. The refrigerant coming from the evaporator, which refrigerant is cold in comparison with the warm refrigerant situated in the compressor housing 1, flows via a suction pipe 17 into the interior of the compressor housing 1 close to the inlet cross section 18 of the muffler 16 when such a known muffler 16 is used, where it mixes with the warm refrigerant already situated in the compressor housing 1 and is heated up and is drawn into the piston-cylinder unit via the muffler 16.

Mufflers 16 according to the state of the art usually consist of several successively connected and/or parallel connected volumes V1, V2, $V_n$ which are connected via pipes with each other, and of an oil separator opening 31 at the lowest point. The cold refrigerant flows via suction pipe 17 into the interior of the compressor housing 1 where as a result of its configuration a first thorough mixing with the warm refrigerant occurs which is already situated in the compressor housing 1. The already mixed and heated refrigerant then flows through the inlet cross section 18 into the first volume V1 and then into the second volume V2 of the muffler 16 and mixes again with the warm refrigerant already situated both in V1 as well as V2, as a result of which there is a renewed heating of the refrigerant. In these known mufflers, the heating between the outlet from suction pipe 17 and shortly before the intake port 24 in the muffler 16 is between 30 K and 40 K, depending on the output of the refrigerant compressor.

Figure 3:
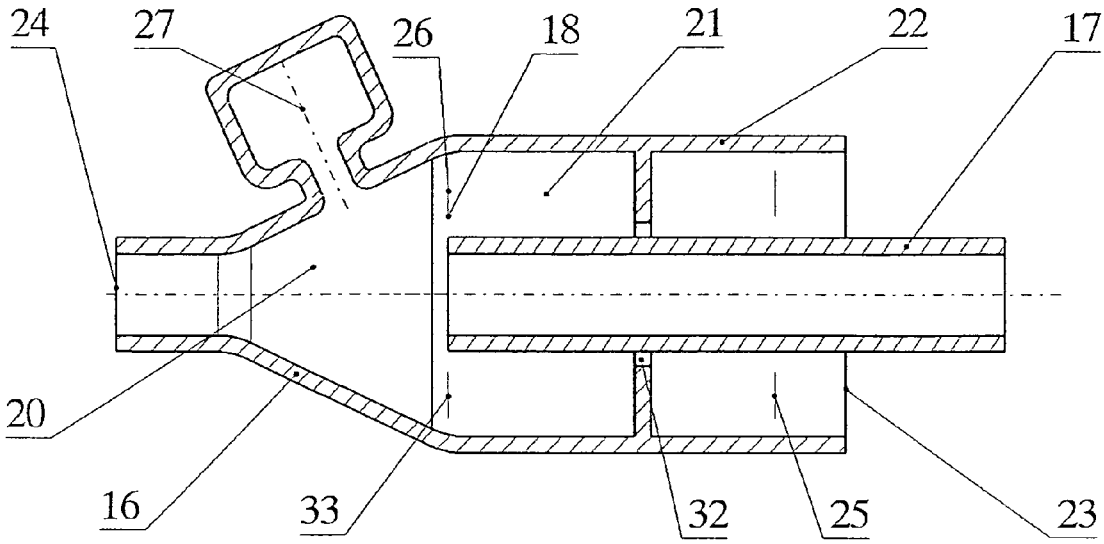
FIG. 3 shows an alternative embodiment of a suction muffler in accordance with the invention.

In order to prevent the undesirable heating, a muffler 16 in accordance with the invention is provided, as shown in FIG. 3 in a sectional view. A compensating volume 21 is connected to the muffler 16 which comprises a filling volume 20 (with the arrangement of several filling volumes being possible and done), which compensating volume comprises a cross-sectional constriction 32. Compensating volume 21 and muffler 16 are formed in accordance with the invention by an outer tube 22 which on the one hand encloses the intake port 24 arranged in the valve plate 11 or opens into the same, and opens on the other hand via a compensating opening 23 into the interior of the compressor housing 1. The outer tube 22 encloses the suction tube 17 at least along an end section.

The cold refrigerant coming from the evaporator and flowing out of the suction pipe 17 flows during the entire intake cycle into the section of the outer tube 22 forming the filling volume 20 of the muffler 16. In the subsequent compression cycle, the filling volume 20 of the muffler 16 can no longer receive any further refrigerant from the suction pipe 17 as a result of the closed intake valve, which is why the refrigerant backs up in the compensating volume 21 which is also formed by a section of the outer tube 22 and displaces the warm refrigerant contained therein via the compensating opening 23 into the interior of the compressor housing 1.

This leads to the formation of a boundary layer 25 between warm and cold refrigerant, which layer is movable depending on the intake cycle. During the next intake cycle, cold refrigerant can be drawn into the cylinder both from the suction pipe 17 as well as from the compensating volume 21 of the outer tube 22. The relevant aspect is that the boundary layer does not exceed the line designated with reference numeral 33, which in this embodiment simultaneously forms the inlet cross section 18 into the muffler 16 or the connecting port 26 between the filling volume 20 and the compensating volume 21, in the direction of the inlet port 24 in order to prevent a thorough mixture of warm and cold refrigerant prior to the intake process.

At the same time, no cold refrigerant is allowed to be displaced from the suction pipe 17 from the compensating volume 21 into the compressor housing 1. The boundary layer 25 must thus not be displaced behind the line marked in FIG. 3 with reference numeral 23 (compensating opening). Irrespective of the embodiment, a precise adjustment of the volume of the compensating volume 21 to the refrigerating output and thus to the working volume of the piston-cylinder unit is necessary.

Figure 4:
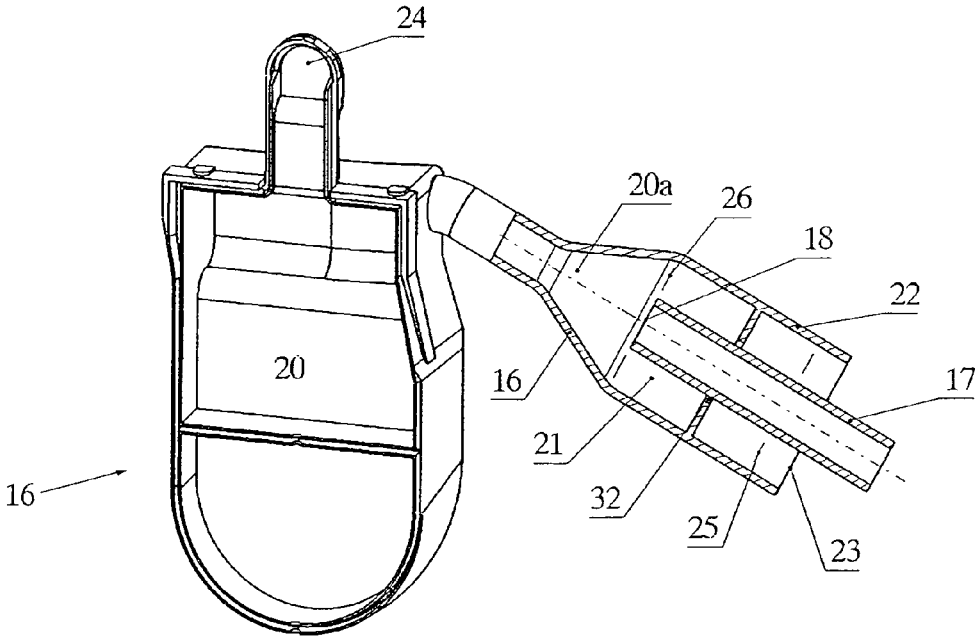
FIG. 4 shows a further alternative embodiment of a suction muffler in accordance with the invention.

FIG. 4 shows a further alternative embodiment of a muffler 16 plus compensating volume 21, in which the muffler 16 is composed of two volumes 20 and 20*a*. In all other respects this variant is identical to the one shown in FIG. 3. In this case, too, it is necessary that the boundary layer 25 always oscillates depending on the intake cycle between the line marked with reference numeral 23 and the inlet cross section 18 or the connecting port 26.

The manner in which the different compensating volumes 21 and the mufflers 16 are configured is of minor importance as long as the inventive features have been realized and the gas column or the boundary layer 25 is able to oscillate in the compensating volume. It is thus possible that as shown in FIG. 3 an additional filling volume 27 can be arranged in the muffler 16.

The muffler 16 in the embodiment according to FIG. 3 merely consists of a filling volume 20 which extends in a substantially conical manner, and in the embodiment according to FIG. 4 of a filling volume 20*a* extending in a substantially conical manner and of the filling volume 20. It is understood that the parallel or serial arrangement of additional volumes of the muffler 16 is possible at any time and leads to improved sound-damping properties of the muffler 16.

As shown especially in FIG. 3, the compensating volume 21 will become the larger (with the length of the outer tube 22 remaining the same) the closer the suction tube is moved towards the intake port 24. The filling volume 20 of the muffler 16 decreases in contrast to this, causing sound problems. FIG. 4 therefore shows an alternative embodiment in which the muffler 16, as already mentioned, consists of two filling volumes 20 and 20*a*. By moving the suction pipe 17 towards the filling volume 20 it is possible to extend the compensating volume 21 without causing any disadvantages to the sound configuration.

In both cases (FIG. 3 and FIG. 4), the muffler 16 and outer tube 22 are preferably configured in an integral manner in order to simplify production. In the case of the embodiment of FIG. 3, the muffler 16 is additionally formed by the outer tube 22.

An important aspect is also the adjustment of the compensating volume to the refrigerating output of the refrigerant compressor, in other words the adjustment to the size of the piston-cylinder unit. Optimal functioning and the desired reduction of the refrigerant temperature at the beginning of the intake process are only guaranteed at a ratio of compensating volume 21 to the working volume of the piston of the piston-cylinder unit of 0.5 to 1.2, because it can be prevented here with guarantee that the oscillating layer 25 will not exceed any of the mentioned boundaries.

If the noise level caused by the operation of the refrigerant compressor is to be reduced in addition, then it is necessary to set the ratio of compensating volume 21 to working volume of the piston of the piston-cylinder unit at 0.5 to 3.

Preferably, the compensating volume also has a circular cross section with a ratio of length to diameter of larger than 10.

The invention claimed is:

1. A hermetically encapsulated refrigerant compressor, comprising:

a hermetically sealed compressor housing;

a piston-cylinder unit disposed in an interior of the housing, said piston-cylinder unit compressing a refrigerant and comprising a suction valve with an intake port arranged in a valve plate of the suction valve;

a suction muffler through which the refrigerant flows to the suction valve of the piston-cylinder unit, said suction muffler being disposed on the cylinder head of the piston-cylinder unit and comprising:

a filling volume;

an inlet cross section through which refrigerant flows into the suction muffler; and a compensating volume in connection with the suction muffler and the interior of the compressor housing and in which the refrigerant oscillates, wherein the inlet cross section is simultaneously a connecting port between the compensating volume and the filling volume, and the compensating volume is formed by an outer tube which tightly encloses the intake port and the inlet cross section and encloses a refrigerant suction pipe at least along a section, wherein the suction pipe extends from the exterior of the compressor housing into the interior of the compressor housing, and wherein the outer tube opens via a compensating opening and communicates with the interior of the compressor housing, and wherein the compensating volume and filling volume are arranged so that refrigerant from the suction pipe flows into the compensating volume by passing through the filling volume.

2. The hermetically encapsulated refrigerant compressor according to claim 1, wherein the suction pipe is guided to a point before the intake port in the outer tube.

3. The hermetically encapsulated refrigerant compressor according to claim 1, wherein the outer tube and the suction muffler are provided with an integral configuration.

4. The hermetically encapsulated refrigerant compressor according to claim 1, wherein the compensating volume is 0.5 to 1.2 times the working volume of the piston of the piston-cylinder unit.

5. The hermetically encapsulated refrigerant compressor according to claim 1, wherein the compensating volume is at least half the working volume of the piston of the piston-cylinder unit.

6. The hermetically encapsulated refrigerant compressor according to claim 1, wherein a smallest flow cross section in the compensating volume has a cross-sectional surface area which corresponds to ¼ to ¾ of a cross-sectional surface area of the intake port.

7. The hermetically encapsulated refrigerant compressor according to claim 1, wherein a cross-sectional surface area of the compensating volume is at most 1.5 times the piston head surface area of the piston of the piston-cylinder unit.

8. The hermetically encapsulated refrigerant compressor according to claim 1, wherein the compensating volume has a circular cross section and a ratio of a length of the compensating volume to its diameter is higher than 10.

* * * * *